US006041619A

United States Patent [19]

Fischer et al.

[11] Patent Number: 6,041,619

[45] Date of Patent: Mar. 28, 2000

[54] METHOD OF LIQUEFYING A NATURAL GAS WITH TWO INTERCONNECTED STAGES

[75] Inventors: Béatrice Fischer; Alexandre Rojey, both of Rueil Malmaison, France

[73] Assignee: Institute Francais du Petrole, Rueil-Malmaison, France

[21] Appl. No.: 09/102,208

[22] Filed: Jun. 22, 1998

[30] Foreign Application Priority Data

Jun. 24, 1997 [FR] France ..... 97 07979

[51] Int. Cl.[7] ..... F25J 1/00

[52] U.S. Cl. ..... 62/612; 62/60

[58] Field of Search ..... 62/623, 612, 613, 62/618, 619

[56] References Cited

U.S. PATENT DOCUMENTS

| | | | |
|---|---|---|---|
| 3,747,359 | 7/1973 | Streich | 62/623 |
| 4,411,677 | 10/1983 | Pervier et al. | 62/623 |
| 4,501,600 | 2/1985 | Pahade | 62/623 |
| 4,592,767 | 6/1986 | Pahade et al. | 62/623 |
| 4,662,919 | 5/1987 | Davis | 62/623 |
| 5,651,269 | 7/1997 | Prevost et al. | 62/613 |
| 5,826,444 | 10/1998 | Capron et al. | 62/612 |

FOREIGN PATENT DOCUMENTS

| | | |
|---|---|---|
| 1270952 | 1/1962 | France . |
| 1314174 | 4/1973 | United Kingdom . |
| 9518345 | 7/1995 | WIPO . |

*Primary Examiner*—William Doerrler
*Attorney, Agent, or Firm*—Antonelli, Terry, Stout & Kraus, LLP

[57] ABSTRACT

Method of liquefying a natural gas wherein a first coolant mixture $M_1$ is used for the first cooling stage and a second coolant mixture $M_2$ for the second cooling stage, said mixture $M_2$ being cooled in the first cooling stage by means of the first coolant mixture (by vaporization after expansion) in order to obtain a condensed, single-phase mixture $M_2$ at the outlet and in that mixture $M_2$ is vaporized to cool the second cooling stage at least partially.

15 Claims, 4 Drawing Sheets

METHOD OF LIQUEFYING A NATURAL GAS WITH TWO INTERCONNECTED STAGES

BACKGROUND OF THE INVENTION

The present invention relates to a method and a device for liquefying a fluid or a gaseous mixture formed at least in part of a hydrocarbon mixture, for example a natural gas.

Natural gas is currently produced at sites remote from the utilization sites and it is commonly liquefied before being transported over long distances by LNG tanker or stored in liquid form.

Throughout the specification, "natural gas" shall be understood to be a mixture whose major component is methane but which may also contain other hydrocarbons and nitrogen in whatever state (gaseous, liquid, or diphasic). At the outset, natural gas is mainly in the gaseous state and at a pressure such that, during the liquefaction stage, it may be in different coexisting states, for example liquid and gas, at any given moment in time.

Natural gas can be liquefied by three main methods known in the prior art and summarized hereinbelow.

A first method consists of operating by means of three cooling cycles in series, each of which operates with a pure substance as a coolant. A first cycle operating with propane condenses ethylene under pressure to a temperature of approximately −35° C. By vaporizing the ethylene at a pressure close to atmospheric pressure in a second cycle, methane is condensed under pressure to a temperature of approximately −100° C. By vaporization of methane, the LNG produced is sub-cooled and can thus be expanded for storage and transportation at a pressure close to atmospheric pressure.

A second method frequently used is described in the prior art, particularly in U.S. Pat. Nos. 3,735,600and 3,433,026, consists of replacing the latter two cycles, an ethylene cycle and a methane cycle, by a single cycle operating with a mixture of coolants. The operating principle of such a cycle is shown schematically in FIG. 1.

The coolant mixture is compressed in a compressor K1, and is then cooled by the ambient cooling fluid available, water or air, in exchanger C1 which it leaves through pipe 1. It is then sent to cooling stage (I) in which it is cooled by means of a propane cycle. At the outlet from stage (I) the mixture leaves through pipe 2 in the liquid-vapor state. The two phases thus obtained are separated in separator B1. The liquid fraction is sent to cooling stage (II) in which it is sub-cooled then expanded through expansion valve VI. As it vaporizes, it cools the natural gas which arrives in cooling stage (II) through pipe 11' as well as the fraction of vapor coolant coming from separator B1, which is sent to cooling stage (II) through pipe 4, down to approximately −100° C. so that the natural gas and the vapor fraction of the coolant mixture can be condensed.

The condensed fraction of coolant mixture thus obtained is sub-cooled then expanded through expansion valve V2. As it vaporizes, it sub-cools the natural gas down to a temperature of approximately −160° C. The liquefied natural gas under pressure that leaves cooling stage (II) through pipe 14 is expanded through expansion valve V3 to a pressure close to atmospheric pressure, producing the LNG which is evacuated through pipe 15.

The natural gas enters cooling stage (I) through pipe 10 and leaves it through pipe 11. It is then sent, as shown in dotted lines in the figure, to a fractionation device from which it is sent by a pipe 11' to cooling stage (II).

A third possibility consists of operating with a single cycle employing a single compressor K1 using the arrangement shown schematically in FIG. 2. The coolant mixture leaving compressor K1 is partially condensed in exchanger C1. The two phases, liquid and vapor, thus obtained are separated in separator B2. The vapor fraction evacuated through pipe 1 plays the same role as the coolant mixture which, in the case of the arrangement shown in FIG. 1, is sent to cooling stage (II). Cooling stage (II) operates similarly in the two arrangements shown schematically in FIGS. 1 and 2. The liquid fraction evacuated from separator B2 through pipe 5 is sub-cooled in cooling stage (I) then expanded through expansion valve V4. Its vaporization furnishes the cooling required in cooling stage (I).

French patent FR 95/15623 by the applicant also proposes operating under selected pressure and temperature conditions to obtain, at the outlet of cooling stage (I), a condensed entirely single-phase coolant mixture in the liquid phase or in dense phase.

"Dense phase" shall be understood hereinbelow to mean a phase at a pressure greater than the cricodenbar pressure of the mixture and at a pressure and temperature such that, by isentropic expansion, it can form a saturated liquid phase.

In this case one can operate according to the diagram in FIG. 3. In this example, cooling stage (II) is comprised of two separate heat exchange areas E1 and E2. The condensed coolant mixture arriving via pipe 2 in cooling area (II) is first vaporized at an intermediate pressure in heat exchange area E1 then vaporized at low pressure in heat exchange area E2. The natural gas leaving heat exchange area E1 through pipe 12 is thus cooled in heat exchange area E1 to a temperature between −100 and −120° C. for example then cooled in heat exchanger area E2 to a temperature of approximately −160° C. The outlet temperature of cooling stage (I) can in this case be for example between −60 and −80° C. while it is approximately −30 to −35° C. when cooling stage (I) is cooled by propane.

The natural gas can then be collected by pipe 11 at an intermediate point of cooling stage (I) and sent to a fractionation device, and re-injected by pipe 11' into exchange area (I).

To reach the cooling temperatures required at the outlets of exchange areas E1 and E2, a coolant mixture comprising methane, ethane, and nitrogen is used. Because of the relatively narrow vaporization temperature range, between 30 and 50° C. for example, it is however necessary to use a coolant mixture with a very high methane concentration which does not allow a regular enthalpy-temperature profile to be obtained, bringing about temperature differences in heat exchange areas E1 and E2 which can be locally considerable. The result is a deterioration in performance.

BRIEF SUMMARY OF THE INVENTION

It has been discovered, and this is the subject of the present invention, that it is possible to improve the operating conditions of a process using a condensed single-phase coolant mixture at the outlet of the first cooling stage (I) by vaporizing it in at least two cooling stages of the process. Thus it is possible to operate by vaporizing the coolant mixture only partially in cooling stage (II) and completing its vaporization in cooling stage (I).

The present invention relates to a method of liquefying a fluid G formed at least in part of hydrocarbons such as a natural gas, comprising at least two cooling stages wherein:

fluid G is cooled in the first stage and at least one coolant mixture $M_2$ is cooled to obtain at least one condensed, single-phase coolant mixture at the end of this first stage, said condensed, single-phase mixture MN coming from the first stage is cooled, vaporized, and expanded to sub-cool at least said fluid G in the second cooling stage and sub-cool at least a part of said condensed, single-phase coolant mixture $M_2$.

The method according to the invention is characterized in that at least a part of said condensed, single-phase coolant mixture $M_2$ is vaporized during the two cooling stages.

According to the method of the invention, a first coolant mixture $M_1$ can be used for the first cooling stage and a second coolant mixture $M_2$ for the second cooling stage, second mixture $M_2$ being cooled in the first cooling stage with the aid of the first coolant mixture (by vaporization after expansion) in order to obtain, at the outlet, a condensed, single-phase mixture $M_2$ and vaporization of mixture $M_2$ can be used to effect cooling of the second cooling stage at least partially.

The coolant mixture $M_2$ is condensed in a single-phase liquid for example or in the dense phase when it leaves the first cooling stage.

The coolant mixture $M_1$ can comprise methane, ethane, propane, and butane and/or coolant mixture $M_2$ can comprise nitrogen, methane, and ethane.

According to a first embodiment of the method, coolant mixtures $M_1$ and $M_2$ are recompressed after expansion using separate compression systems, then cooled by the ambient cooling medium available in the separate heat exchange areas.

According to a second embodiment of the method, a total coolant mixture, compressed with the aid of a single compression system, is cooled and condensed at least partially to produce a liquid fraction and a vapor fraction and this liquid fraction is used as first coolant mixture $M_1$ and the vapor fraction as second coolant mixture $M_2$ and, after expansion and vaporization, coolant mixtures $M_1$ and $M_2$ are re-mixed and recycled to the compression system.

The total coolant mixture from which the liquid and vapor fractions are obtained comprises, for example, nitrogen, methane, ethane, propane, and butane.

The second cooling stage can comprise several heat exchange areas and cooling can then be effected by using coolant mixture $M_2$ which is expanded and vaporized at decreasing pressure levels, whereby vaporization of the mixture fraction providing cooling of one area is continued in the preceding area and vaporization of the cooling fraction providing cooling of the first area is continued and completed in the first cooling stage.

The first cooling stages comprises, for example, several heat exchange areas and cooling can be effected in said successive heat exchange areas using a coolant mixture $M_1$ which is expanded and vaporized at decreasing pressure levels.

At the outlet of the first cooling stage, coolant mixture $M_2$ can be at a pressure of at least 3 MPa and a temperature of −40° C. or less.

BRIEF DESCRIPTION OF THE DRAWINGS

Other characteristics and advantages of the method according to the invention will emerge from the description hereinbelow of embodiments described as nonlimiting examples with referenced to the attached drawings wherein.

DETAILED DESCRIPTION OF THE INVENTION

Figure 1:
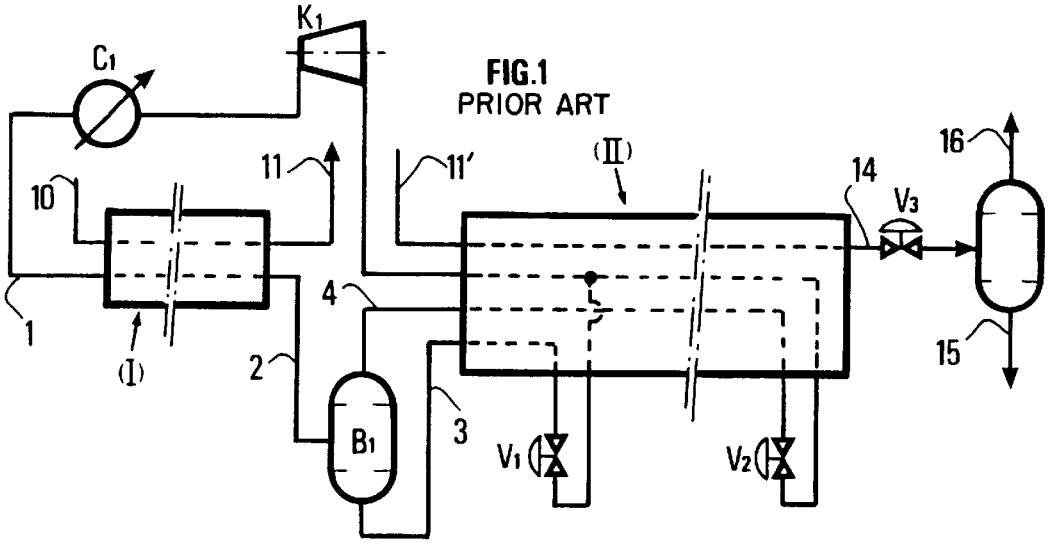
FIG.1 PRIOR ART
FIGS. 1 and 2 show natural gas liquefaction methods according to the prior art.
Figure 2:
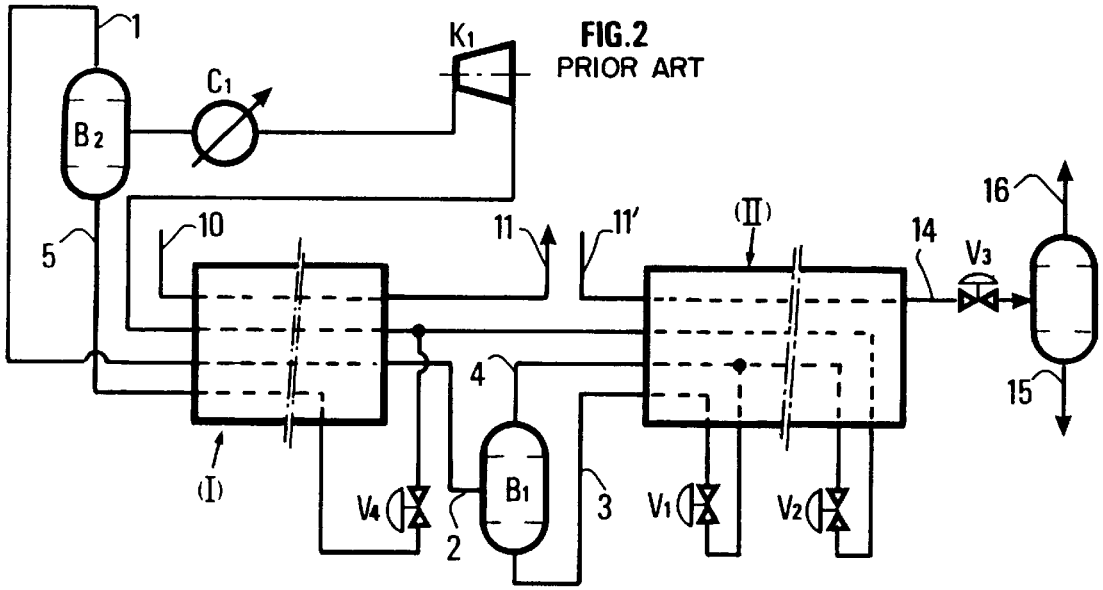
FIG.2 PRIOR ART
Figure 3:
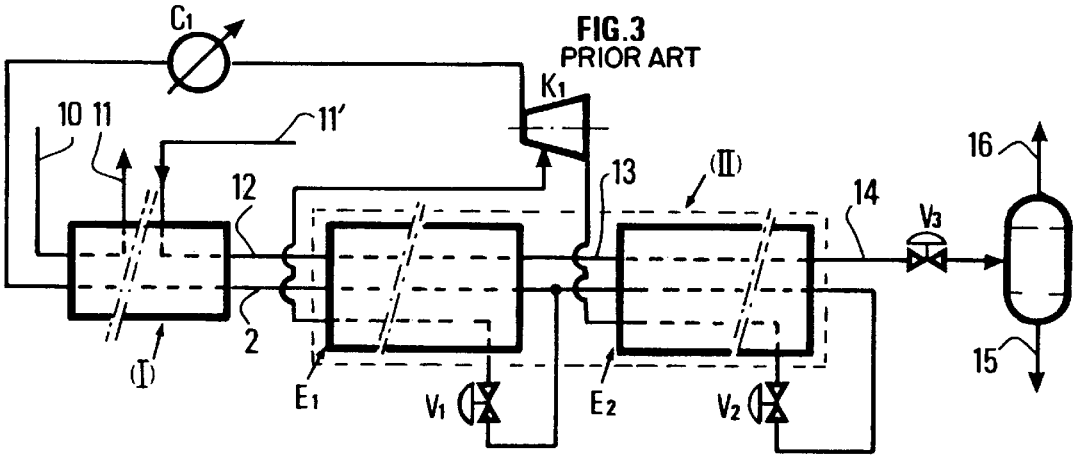
FIG.3 PRIOR ART
FIG. 3 shows a method of the applicant according to the prior art operating with and using a condensed single-phase coolant mixture, all or at least most of which is vaporized in the first cooling stage.
Figure 4:
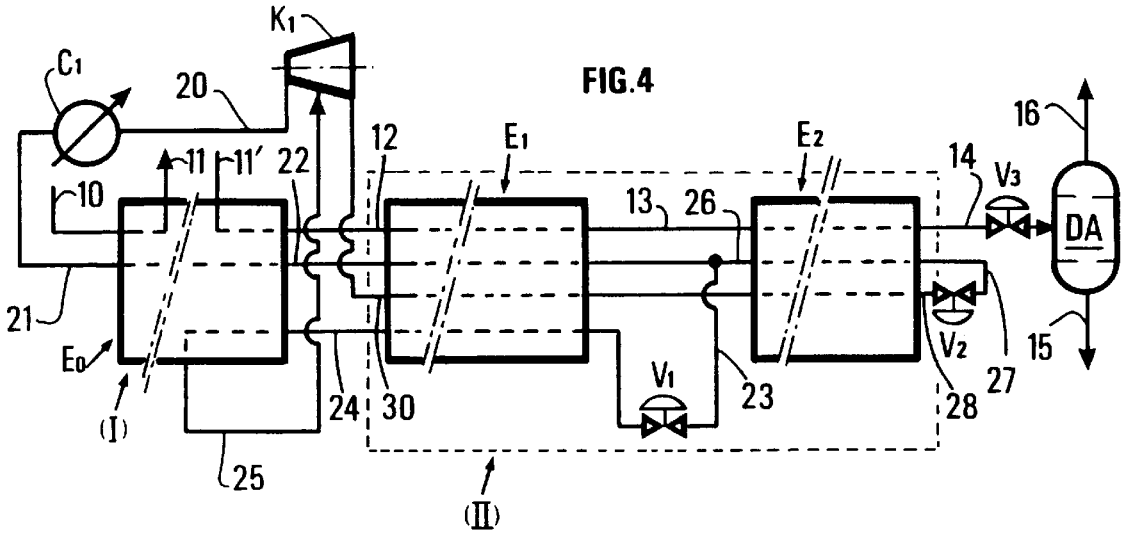
FIG. 4 shows the method according to the invention schematically.

In this case, one operates for example according to the diagram shown in FIG. 4. In this figure, only the cooling circuit followed by coolant mixture $M_2$ is shown. Certain elements common to FIGS. 3 and 4 have the identical reference numerals and the technical teaching of document FR 95/15 623 necessary for understanding the invention is incorporated herein by reference, in particular the aforementioned passages relating to the stages of natural gas liquefaction.

The idea and the object of the present invention consist principally of vaporizing the condensed, single-phase coolant mixture obtained at the outlet of the first cooling stage in a different way, for example by vaporizing in several cooling stages and/or in several exchange areas.

In FIG. 4, coolant mixture $M_2$ leaves compression system K1 through pipe 20. It is then cooled by heat exchange with the ambient cooling environment such as air or water available in heat exchanger C1 which it leaves through pipe 21 to be sent to first cooling stage (I), or cooling stage, where it is cooled at the same time as the natural gas introduced through pipe 10. The pressure and temperature at the outlet of cooling stage (I) are chosen such that coolant mixture $M_2$ is single-phase and condensed when it leaves this stage. The pressure is greater than 3.5 MPa for example and the temperature is between −60 and −80° C. for example. Condensed, single-phase mixture $M_2$ leaving first cooling stage (I) can be either in the liquid phase or in the dense phase.

In this embodiment, cooling stage (I) has a heat exchanger area EO while second cooling stage (II) has two heat exchange areas E1 and E2 arranged in cascade.

Condensed, single-phase mixture M. leaving first cooling stage (I) is sent through pipe 22 to second cooling stage (II), first into heat exchange area E1 where it is sub-cooled. At the outlet from this sub-cooling stage, a fraction F1 of this mixture leaves through pipe 23 and is expanded through an expansion valve VI to a first pressure level P1.

Partial vaporization of this first mixture fraction F1 provides, in heat exchange area E1, part of the cooling necessary to cool the natural gas and sub-cool mixture $M_2$ which is vaporized at least in part but not in full.

Indeed, and this is one of the essential features of the present invention, vaporization of mixture $M_2$ is effected and completed in first cooling stage (I) where it is introduced through a pipe 24 and which it leaves through a pipe 25 to be sent to compression system K1, this mixture fraction being at an intermediate pressure when it leaves the stage, and is sent for example to the outlet of the first compression stage.

Another fraction F2 of mixture $M_2$ is sent through pipe 26 to heat exchange area E2 where it is sub-cooled once again. It leaves this area E2 through a pipe 27 and is then expanded through an expansion valve V2 to a second pressure level P2 less than first pressure level P1. The expanded mixture fraction is sent to exchange area E2 through a pipe 28 and its at least partial vaporization provides, in this heat exchange area E2, the cooling necessary to cool the natural gas and sub-cool the mixture $M_2$ introduced through pipe 26. Vaporization of mixture $M_2$ is effected and completed in heat exchange area E1 before leaving via a pipe 30.

The vapor mixture fraction leaving at low pressure via pipe 30 of heat exchange area E1 is sent to a first compression stage of compression system K1.

This vapor mixture fraction is mixed at the outlet of the first compression system stage with the vapor mixture fraction introduced at the outlet of the first compression stage through pipe 25, the resulting mixture then being compressed in second compression stage K1, the mixture thus compressed being sent through pipe 20 to heat exchanger E1. Cooling stages (I) and (II) are interconnected in this case.

The liquefaction process according to the invention is characterized in that at least part of the condensed single-phase coolant mixture $M_2$ is vaporized during both cooling stages.

In the example shown schematically in FIG. 4, coolant mixture $M_2$ is vaporized at two pressure levels. It can also be vaporized at a single pressure level. In this case, the two heat exchange areas E1 and E2 are regrouped into a single heat exchange area forming the second cooling stage (II). According to other embodiments, the mixture can be vaporized at more than two pressure levels, for example three or four, the second cooling stage (II) being redesigned as a consequence and having three or four heat exchange areas, respectively. In these embodiments, cooling is provided at the second heat exchange area in the successive heat exchange areas wherein coolant mixture $M_2$ is expanded and vaporized at decreasing pressure levels, with vaporization of the mixture fraction providing cooling in one area being continued in the previous area and vaporization of the mixture fraction providing cooling of the first area being continued and completed in the first cooling stage.

The natural gas to be liquefied is sent, at a temperature of approximately 40° C. for example, and at a pressure of approximately 6 MPa, through a pipe 10 to first heat exchange area (I) where it is cooled at least by one coolant mixture $M_1$. When it leaves this first stage, it is at a temperature of preferably at least less than −40° C. and at a pressure essentially equal to its initial pressure value. It is then sent through a pipe 12 to second cooling stage (II), successively into heat exchange areas E1 and E2 which are connected by a pipe 13. When leaving this second cooling stage it is at the desired final temperature, for example approximately −160° C., before being evacuated through a pipe 14 and expanded through an appropriate device such as a valve V3 or a turbine. It is then separated in a separator tank DA, the liquid fraction resulting from this separation being evacuated through a pipe 15 and the vapor fraction, through a pipe 16 located at the head of the tank.

In the case of the arrangement shown schematically in FIG. 4, cooling of first cooling stage (I) is provided at least partially by a separate cooling circuit comprising at least compression system K1. This cooling circuit can for example operate with the arrangement shown schematically in FIG. 5, which shows at least the first cooling stage (I).

Coolant mixture $M_1$ used in a first cooling stage (cooling stage (I)) is compressed in compression system K10. It is then cooled and condensed in condenser C10 with the aid of the available cooling ambient medium, air or water. Mixture $M_1$ is then sent through pipe 40 to first cooling stage (I) comprising in this example three heat exchange areas E10, E11, and E12. It is sub-cooled successively in heat exchange areas E10, E11, and E12, these areas communicating with each other respectively by pipes 41 and 42, sub-cooled mixture $M_1$ being evacuated through a pipe 43 connected to the last area.

A first fraction $F_1$ $M_1$ of mixture $M_1$ which was sub-cooled in heat exchange area E10 passes through a pipe 44 and is expanded through expansion valve V10 and vaporized at a first pressure level $P_1$ $M_1$. Vaporization of this first fraction $F_1$ $M_1$ of mixture $M_1$ provides, at least in part, the cooling required in heat exchange area E10 by countercurrent circulation in pipe 45. This first fraction $F_1$ $M_1$ emerges from heat exchange area E10 through a pipe 46 and is then sent for example to an outlet stage of compression system K1.

The nonexpanded fraction is sent to the second heat exchange area where it is expanded. When it leaves this area E11, a second fraction $F_2$ $M_1$ of mixture $M_1$ is expanded through an expansion valve V11 disposed in a pipe 47, to a second pressure level $P_2$ $M_1$ less than the first. Vaporization of this second mixture fraction $M_1$ provides the cooling required in heat exchange area E11 by countercurrent circulation through pipe 48. This second fraction $F_2$ $M_1$ of mixture $M_1$ then passes into heat exchange area E10 from which it emerges through a pipe 49 at a temperature close to the temperature of the available ambient medium, air or water. When it leaves exchange area E10, the mixture fraction is sent to the compression system through pipe 49 to a stage of lower rank than the stage to which the first mixture fraction is sent.

The mixture fraction not expanded through valve V11 is sent to heat exchange area E12. A fraction $F_3$ $M_1$ of mixture $M_1$ that was sub-cooled in this heat exchange area E12 is expanded through expansion valve V12 to the lowest pressure, for example close to atmospheric pressure. Vaporization of this latter mixture fraction $M_1$ provides, in part, the cooling required in heat exchange area E12 by circulating countercurrent-wise for example in a pipe 50. This mixture fraction $M_1$ leaving heat exchange area E12 in the vapor phase at low pressure is sent through a pipe 51 to the first compression stage of compression system K10.

When it leaves the first compression stage of compression system K10, the mixture of the compressed fraction and the second fraction leaving heat exchange area E10 through pipe 49 is sent to the second compression stage. When it leaves this second stage, the compressed mixture is cooled in an exchanger C11 with the aid of the available ambient medium, water or air, and mixed with the fraction expanded to the highest intermediate pressure level, which leaves heat exchange area E10 though pipe 46. The compressed mixture resulting from all the various mixture fractions, recompressed, leaving compression system K10, is then sent to exchanger C10.

Moreover, in this arrangement example, vaporization of mixture $M_2$ is effected and completed in heat exchange area E12. In other embodiments, it can also be effected and/or completed in heat exchange areas E10 and E11. In the arrangement example shown schematically in FIG. 5, vaporization of mixture $M_2$ provides additional cooling in heat exchange area E12.

Figure 5:
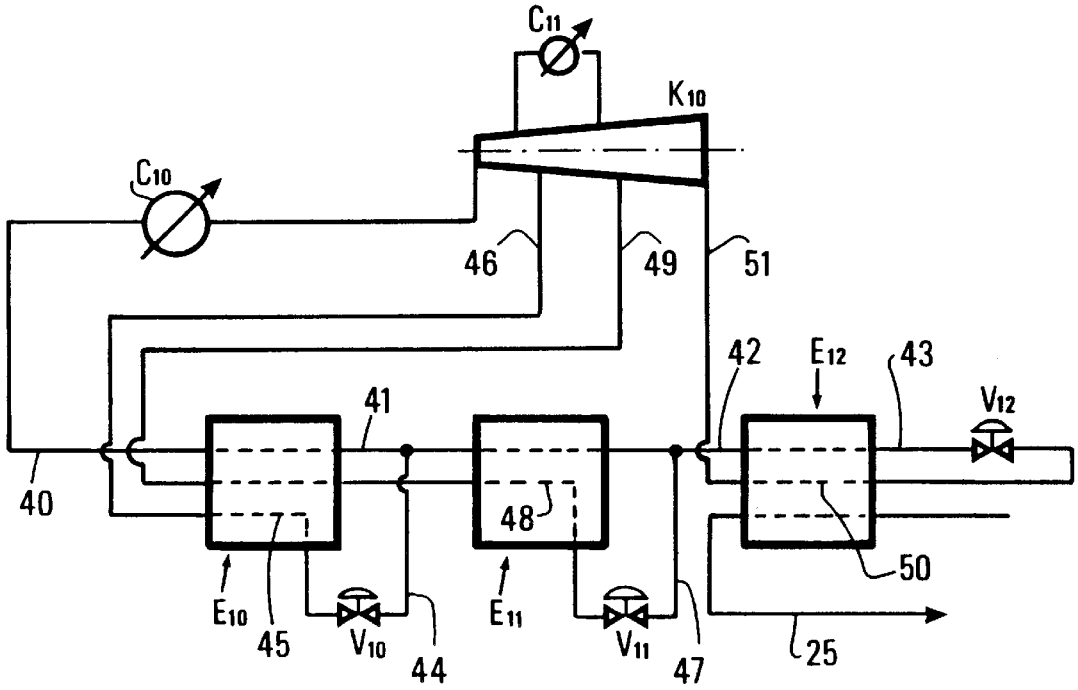
FIG. 5 shows a variant for effecting the first cooling stage.

In the arrangement example shown schematically in FIG. 5, the coolant mixture $M_1$ used for creating the first cooling stage is vaporized at three pressure levels. The number of expansion pressure levels can be different, for example two or four. In this case, the first cooling stage (I) has as many heat exchange areas such as those shown schematically in FIG. 5 as it has expansion pressure levels. Cooling is then provided in successive heat exchange areas in which the coolant mixture $M_1$ is expanded and vaporized at decreasing pressure levels, following the order in which the heat exchange areas are arranged.

According to another method, it is possible to continue vaporization of the coolant mixture $M_1$ carried out in one heat exchange area in an adjacent heat exchange area, for example the preceding area.

The coolant mixture $M_1$ used in cooling stage (I) can have at least one or more of the following components: methane, ethane, propane, butane, and pentane.

The coolant mixture $M_2$ used in cooling stage (II) can have at least one or more of the following components: methane, ethane, propane, nitrogen.

At the outlet from cooling stage (I), coolant mixture $M_2$ is preferably at a pressure of at least 3 MPa and at a temperature of at least less than −40° C.

EXAMPLE

Figure 6:
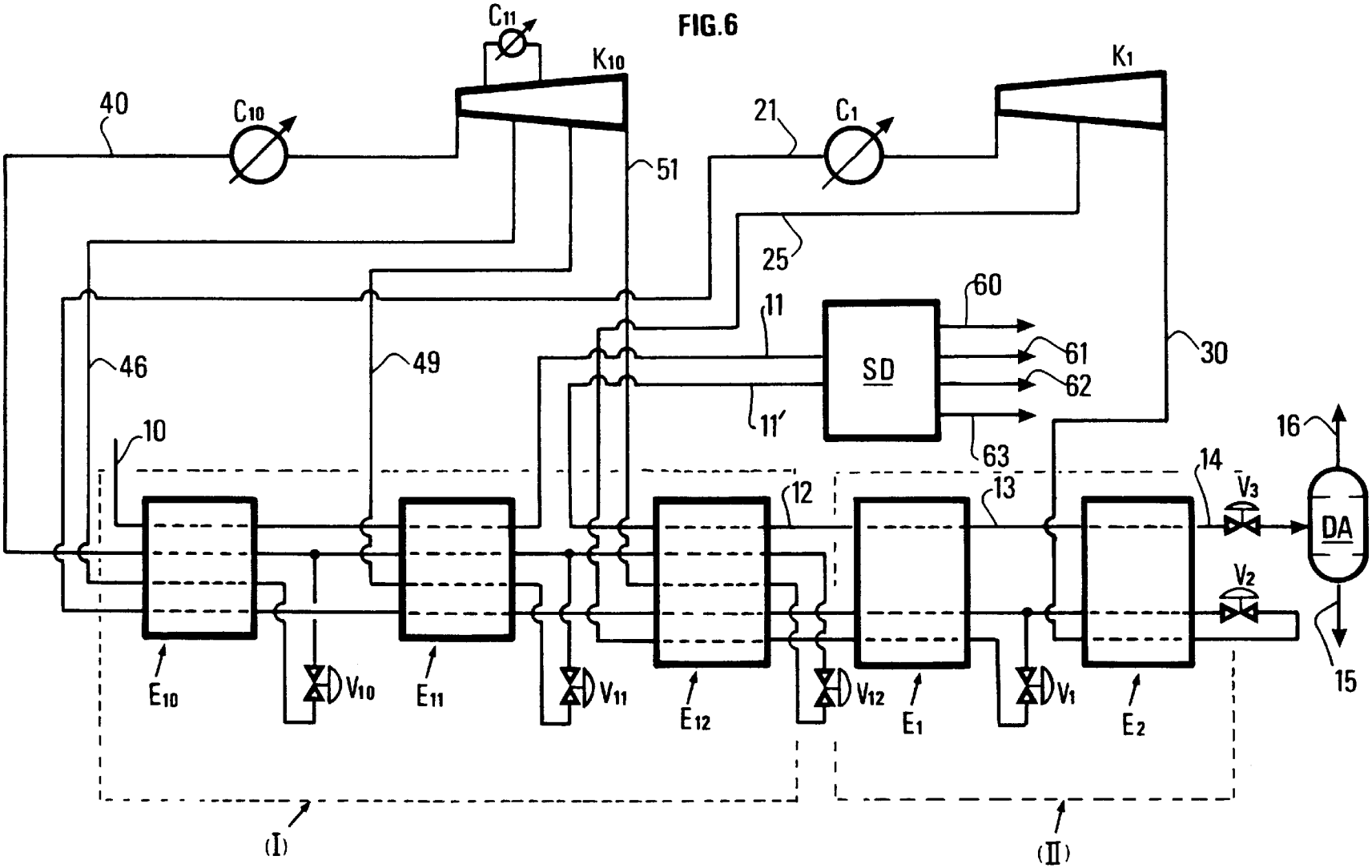
FIG. 6 illustrates the numerical example of a natural gas.

The method according to the invention is illustrated by the following numerical example, described with reference to the diagram in FIG. 6, wherein the first cooling stage is provided in three heat exchange areas E10, E11, and E12 arranged in cascade and the second cooling stage (II) in heat areas E1 and E2.

A natural gas whose volume percent composition is the following:

methane: 86
nitrogen: 4
ethane: 5
propane-butane: 4
C5+fraction: 1is introduced through pipe 10 at a pressure of 6.8 MPa and a temperature of 45° C.

It is first cooled in heat exchange areas E10, E11, and E12 which constitute cooling stage (I). This cooling stage employs a coolant mixture $M_1$ whose composition is as follows in molar fractions (%)

methane: 1.9
ethane: 27.8
propane: 53.8
butane: 16.3
C5+fraction: 0.2

This mixture is compressed at a pressure of 2.66 MPa in compression system K10. It is cooled to a temperature of 45° C. in exchanger C10 which it leaves in condensed form. It is sub-cooled sequentially in heat exchanger areas E10, E11, and E12. At the outlet from heat exchange area E10, it is expanded through expansion valve V10 and vaporized in heat exchange area E10 whence it is sent through pipe 46 at a pressure of 1.24 MPa to compression system K10. At the outlet of exchange area E11, it is expanded through expansion valve V11 and vaporized in heat exchange area E11, whence it is sent through pipe 49 at a pressure of 0.5 MPa to compression system K10.

The natural gas leaves heat exchange area E11 through pipe 11 at a temperature of −20° C. and is then sent to gasoline extraction and fractionation system SD from which the ethane, propane, butane, and C5+ fractions leave through pipes 60, 61, 62, and 63 respectively. The methane, nitrogen, and residual fractions of ethane, propane, butane, and C5+ form a gaseous mixture which is sent through pipe 11' to heat exchange area E12 which it leaves through pipe 12 at a temperature of −58.5° C.

Heat exchange area E12 is cooled by expansion through valve V12 and vaporization of the coolant mixture of cooling stage (I) in heat exchange area E12, whence it is sent through pipe 51 at a pressure of 0.12 MPa to compression system K10.

The natural gas leaving heat exchange area E12 through pipe 12 is then cooled in heat exchange areas E1 and E2, which constitute cooling stage (II). This cooling stage employs a mixture of coolants whose composition is as follows in molar fractions (%):

methane: 49.7
nitrogen: 0.2
ethane: 35.4
propane: 13.3
C4+fraction: 1.4

This mixture is compressed to a pressure of 3.79 MPa in compression system K1. It is cooled to a temperature of 45° C. in exchanger C1 then in heat exchange areas E10, E11, E12, and leaves heat exchange area E12 in condensed form. It is sub-cooled sequentially in heat exchange areas E1 and E2. When it leaves heat exchange area E1, it is expanded through expansion valve V1 and partially vaporized in heat exchange area E1. Its vaporization is continued and completed in heat exchange area E12, whence it is sent through pipe 23 at a pressure of 0.7 MPa to compression system K1. Sub-cooling of the mixture not expanded through expansion valve V1 is continued in heat exchange area E2. As it leaves heat exchange area E2, the mixture sub-cooled in this way is expanded through expansion valve V2 and vaporized in heat exchange area E2 whence it is sent through pipe 77 to compression system K1 at a pressure of 0.12 MPa.

The natural gas leaving through pipe 14 under pressure in the liquid form is expanded through expansion valve V3 and sent to the system DA extracting nitrogen by distillation. The LNG produced leaves through pipe 15 at a pressure of 0.13 MPa and a temperature of −160° C. The off gas, which represents 1.05 kmol for production of 10 kmol of LNG, is evacuated through pipe 16.

Figure 7:
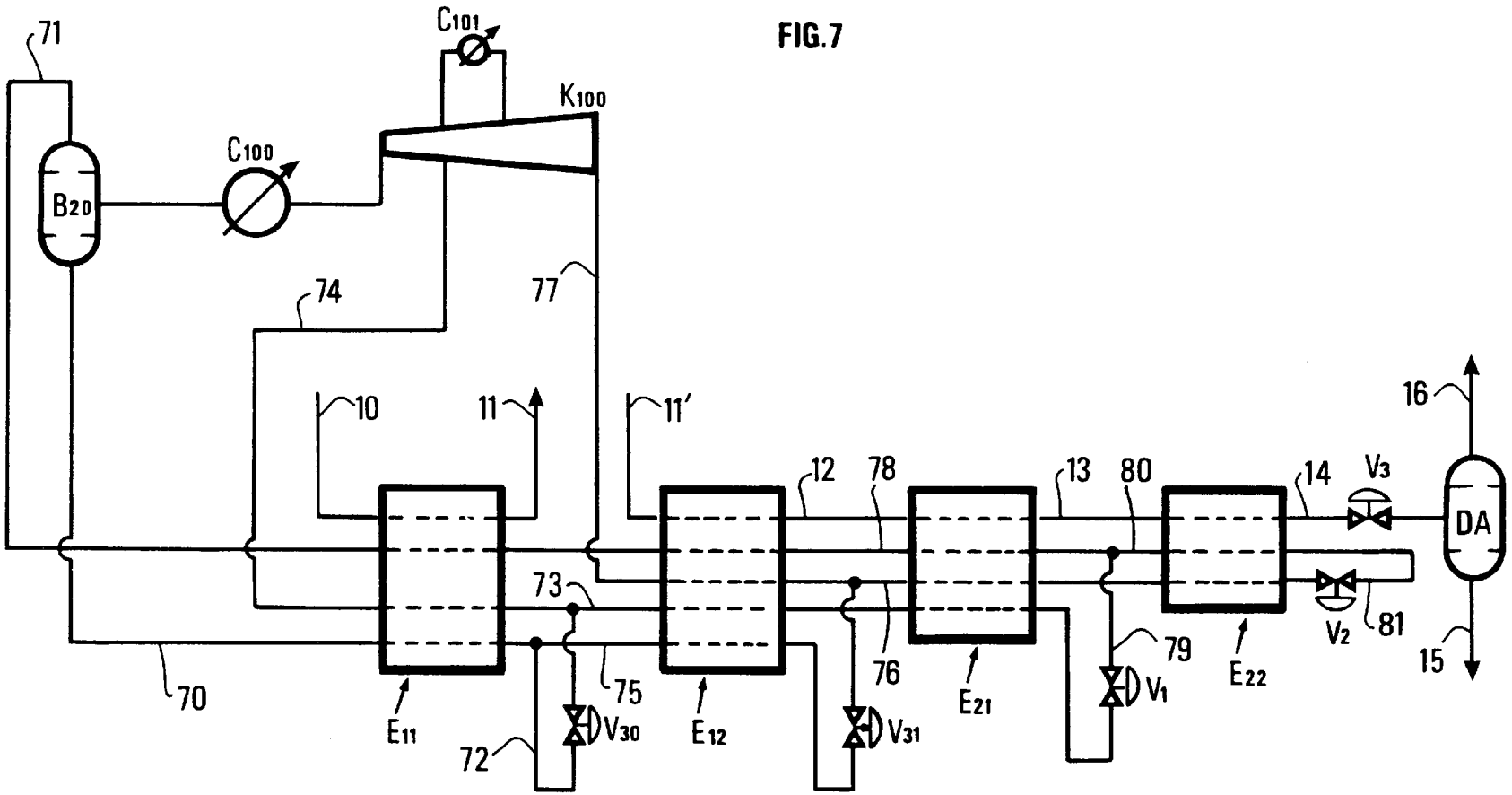
FIG. 7 shows schematically a variant operating with a single cycle.

FIG. 7 shows schematically another embodiment of the method according to the invention operating with a single cycle using a single compression system, fractionating the coolant mixture compressed by cooling and condensation, and obtaining at least one liquid fraction and at least one vapor fraction. The liquid fraction can be used to constitute mixture $M_1$ and the vapor fraction, to constitute mixture $M_2$, the vaporization operation of said mixture being distributed over the various cooling stages (I) and (II).

The initial compressed coolant mixture is cooled with the aid of the ambient fluid, water or air, available in exchanger C100 which it leaves in the partially condensed form. The liquid and vapor fractions are separated in separator drum B12 and evacuated through pipes 70 and 71 respectively. The liquid fraction constituting mixture $M_1$ is sent through pipe 70 to heat exchange area E11 in which it is sub-cooled. When it leaves heat exchange area E11, a fraction of this mixture $M_1$ is evacuated via a pipe 72 through expansion valve V30, mixed with the vapor fraction arriving from heat exchange area E12 via pipe 73, and vaporized in heat exchange area E11. The vapor phase leaving heat exchange area E11 through pipe 74 is sent to compression system K100. The liquid fraction of mixture $M_1$ which is not expanded through expansion valve V30 is sent via pipe 75 to heat exchange area E12. At the outlet from heat exchange area E12, it is expanded through expansion valve V31, mixed with the vapor fraction arriving from heat exchange area E21 through pipe 76, and vaporized in heat exchange area E12. The vapor phase leaving heat exchange area E12 through pipe 77 is sent to the inlet of compression system K100. At the outlet from a first stage of compression system K100, this vapor phase is cooled with the aid of the ambient cooling medium, air or water, available in heat exchanger C101, then mixed with the vapor fraction arriving through pipe 74.

The vapor fraction leaving separator drum B20 through pipe 71 and constituting mixture $M_2$ passes successively through heat exchange areas E11 and E12 which constitute cooling stage (I) and leaves heat exchange area E12 through pipe 78 in the single-phase, condensed form. The condensed, singe-phage mixture thus obtained is then sent to second cooling stage (II) comprising for example two heat exchange areas E21 and E22 in which it is sub-cooled in first heat exchange area E21. At the outlet of heat exchange area 21, a first fraction of mixture $M_2$ is sent through pipe 79 to valve V1 and expanded through this valve. This first fraction is then partially vaporized in heat exchange area E21 with vaporization continuing and being completed in heat exchange area E12 from which the vaporized fraction of mixture $M_2$ leaves through pipe 73. The fraction of mixture $M_2$ which is not expanded through valve V1 is sent via pipe 80 to heat exchange area E22 in which it is sub-cooled, sent via a pipe 81 to be expanded through expansion valve V2, and partially vaporized in heat exchange area E22, with vaporization continuing and being completed in heat exchange area E21, from which the vaporized fraction of mixture $M_2$ leaves through pipe 76.

The natural gas is introduced into heat exchange area E11 via pipe 10. At the outlet from heat exchange area 11, it can be sent to a fractionation device through pipe 11 and according to, for example, the diagram shown in FIG. 6 in which some of the hydrocarbons heavier than methane are separated by distillation for example. Cooling of the natural gas is then continued in heat exchange areas E12, E21, and E22. It leaves in the liquid form, sub-cooled under pressure, through pipe 14 of heat exchange area E22. It is then expanded through expansion valve V13 to form the LNG which is evacuated through pipe 15.

Various types of equipment can be used while remaining within the framework of the present invention.

It is possible to use tubular or shell and tube type exchangers or plate-type exchangers. The heat exchange areas comprising the cooling stages (I) and (II) are advantageously made of plate exchangers which can for example be plate exchangers made of brazed aluminum or stainless steel for example. For each exchange area, it is possible to use one or more plate exchangers in parallel. A given plate exchanger can also be used for making several heat exchange areas in series on the condition that the intermediate fluid taps necessary are provided.

Some at least of the expansion valves can be replaced by turbines that recover the mechanical energy of expansion.

Various types of compressors can be used, for example centrifugal compressors or axial compressors.

We claim:

1. Method of liquefying a fluid G formed at least in part of hydrocarbons in at least first and second cooling stages, comprising:

cooling fluid G in the first stage and cooling at least one coolant mixture $M_2$ in the first stage to obtain at least one condensed, single-phase coolant mixture at the end of this first stage;

separating said condensed, single-phase mixture $M_2$ coming from the first stage into at least first and second coolant mixture parts of $F_1$ and $F_2$;

expanding and only partially vaporizing the first coolant mixture parts $F_1$ at a first level of pressure $P_1$ in the second cooling stage so as to subcool at least a part of the coolant mixture $M_2$, then completing vaporization of the first coolant mixture part $F_1$ in the first cooling stage; and cooling, vaporizing and expanding the second coolant mixture part $F_2$ at a second level of pressure $P_2$ to subcool at least said fluid G in the second cooling stage and subcool at least a part of said condensed, single-phase coolant mixture $M_2$.

2. Method according to claim 1, characterized in that a first coolant mixture $M_1$ is used for the first cooling stage and a second coolant mixture $M_2$ is used for the second cooling stage, said second mixture $M_2$ being cooled in the first cooling stage with the aid of the first coolant mixture in order to obtain, at the outlet, a condensed, single-phase mixture $M_2$ and in that vaporization of mixture $M_2$ is used to effect cooling of the second cooling stage at least partially.

3. Method according to claim 1, characterized in that coolant mixture $M_2$ is condensed in a single-phase liquid when it leaves the first cooling stage.

4. Method a natural gas according to claim 2, characterized in that coolant mixture $M_2$ is a single-phase condensed dense phase when it leaves the first cooling stage.

5. Method according to claim 2, characterized in that coolant mixture $M_1$ comprises methane, ethane, propane, and butane and/or coolant mixture $M_2$ comprises nitrogen, methane, and ethane.

6. Method according to claim 2, characterized in that coolant mixtures $M_1$ and $M_2$ are recompressed after expansion using separate compression systems, then cooled by the ambient cooling medium available in the separate heat exchange areas.

7. Method according to claim 2, characterized in that a total coolant mixture, compressed with the aid of a single compression system, is cooled and condensed at least partially to produce a liquid fraction and a vapor fraction and this liquid fraction is used as coolant mixture $M_1$ and the vapor fraction as coolant mixture $M_2$ and, after expansion and vaporization, coolant mixtures $M_1$ and $M_2$ are re-mixed and recycled to the compression system.

8. Method according to claim 7, characterized in that the total coolant mixture comprises nitrogen, methane, ethane, propane, and butane.

9. Method according to claim 1, characterized in that, at the outlet of the first cooling stage, coolant mixture $M_2$ is at a pressure of at least 3 MPa and a temperature of −40° C.

10. Method according to claim 1, wherein the pressure $P_2$ is less than the pressure $P_1$.

11. Method according to claim 1, wherein the coolant mixture $M_2$ comprises nitrogen, methane and ethane.

12. Method according to claim 5, wherein the coolant mixture $M_2$ comprises nitrogen, methane and ethane.

13. Method according to claim 1, wherein several zones of heat exchange are used for the second stage of cooling and wherein the expanded, vaporized at decreasing levels of pressure coolant mixture is used for cooling these zones, the vaporisation of the part of the coolant mixture used for cooling a stage being pursued in the previous cooling zone and the vaporization of the mixture used in the first zone being pursued and finalised in the first stage.

14. Method according to claim 2, wherein several zones of heat exchange are used for the first coolant stage and the expanded, vaporized at decreasing levels of pressure coolant mixture $M_1$ is used for cooling said successive zone of heat exchange.

15. Method according to claim 1, wherein the fluid G is natural gas.

* * * * *